US006843958B1

(12) United States Patent
Korbik et al.

(10) Patent No.: US 6,843,958 B1
(45) Date of Patent: Jan. 18, 2005

(54) COPPER COOLING PLATE FOR METALLURGICAL FURNACES

(75) Inventors: Elmar Korbik, Essen (DE); Franz Reufer, Düsseldorf (DE); Mary Brandt, Oberhausen (DE); Axel Kubbutat, Oberhausen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/070,650

(22) PCT Filed: Sep. 7, 2000

(86) PCT No.: PCT/EP00/08726

§ 371 (c)(1),
(2), (4) Date: Jun. 11, 2002

(87) PCT Pub. No.: WO01/20045

PCT Pub. Date: Mar. 22, 2001

(30) Foreign Application Priority Data

Sep. 19, 1999 (DE) ..... 199 43 287

(51) Int. Cl.[7] ..... C21B 7/10
(52) U.S. Cl. ..... 266/194; 266/193
(58) Field of Search ..... 266/193, 194, 266/197

(56) References Cited

U.S. PATENT DOCUMENTS 5,650,119 A * 7/1997 Hille et al. ..... 266/193
5,904,893 A 5/1999 Stein

FOREIGN PATENT DOCUMENTS

| | | | |
|---|---|---|---|
| DE | 710923 | | 8/1941 |
| DE | 2743380 | | 6/1978 |
| DE | 296 08 464 U1 | | 9/1996 |
| DE | 198 06 788 A1 | | 8/1999 |
| EP | 0837144 | | 4/1998 |
| FR | 2345680 | | 10/1977 |
| JP | 07-109506 | * | 4/1995 |

OTHER PUBLICATIONS

Patent Abstracts Of Japan, Col. 1995, No. 07, Aug. 31, 1995 & JP 07 109506 A (Nippon Steel Corp), Apr. 25, 1995.
Patent Abstracts Of Japan, vol. 1996, No. 08, Aug. 30, 1996 & JP 08 104910 A (Nippon Steel Corp), Apr. 23, 1996.
Patent Abstracts Of Japan, vol. 1995, No. 02, Mar. 31, 1995 & JP 06 322419 A (Nippon Steel Corp), Nov. 22, 1994.

* cited by examiner

*Primary Examiner*—Scott Kastler
(74) *Attorney, Agent, or Firm*—Friedrich Kueffner

(57) ABSTRACT

A metallurgical furnace provided with a refractory lining and an outer furnace steel jacket, having copper cooling plates, wherein a flow of cooling medium flows through the cooling plates arranged between the furnace steel jacket and the refractory lining. Cooling medium pipes of the copper cooling plate provided for supplying and removing the cooling medium are guided through the furnace steel jacket to the exterior and are gas-tightly welded to the furnace steel jacket. The copper cooling plate is connected free of play in all spatial directions to the furnace steel jacket, in addition to attachment by way of the cooling medium pipes welded to the furnace steel jacket, by at least one fixed-point fastening element that is welded to the furnace steel jacket. The at least one fixed-point fastening element is arranged within at least one of the upper part and the lower part of the copper cooling plate in immediate proximity of the cooling medium pipes.

6 Claims, 2 Drawing Sheets

COPPER COOLING PLATE FOR METALLURGICAL FURNACES

Figure 1:
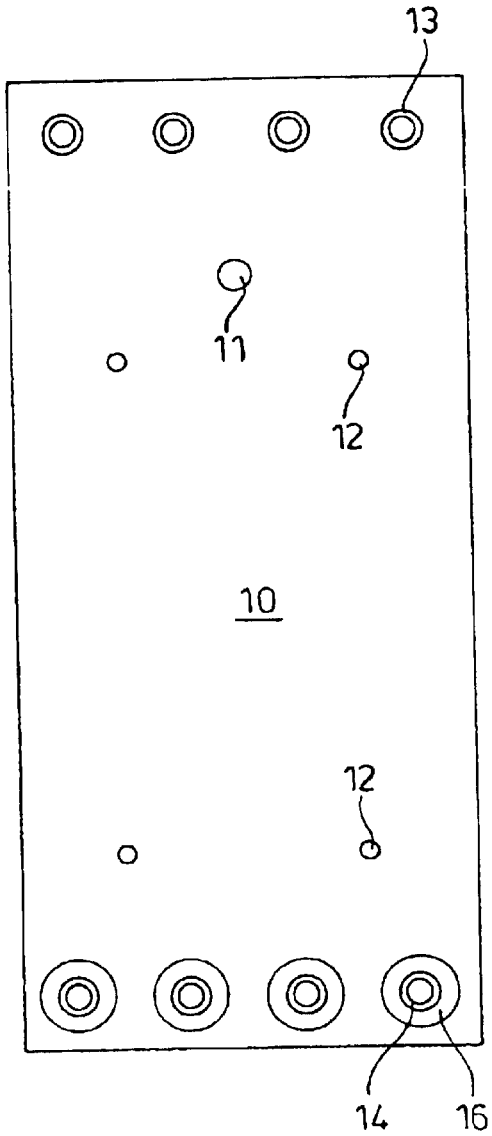

The invention relates to a copper cooling plate for metallurgical furnaces, such as blast furnaces, melting or melt-reduction furnaces, provided with a refractory lining and an outer furnace steel jacket, wherein a cooling medium flows through the cooling plates arranged between the furnace steel jacket and the refractory lining, wherein the cooling medium pipes of the copper cooling plate provided for supplying and removing the cooling medium are guided through the furnace steel jacket to the exterior and are gas-tightly welded to the furnace steel jacket.

Copper cooling plates (so-called Cu staves) made of copper or a low-alloy copper alloy with cooling medium channels arranged in their interior, manufactured by rolling, forging or casting, have normally four cooling medium pipes at the upper side and four cooling medium pipes at the lower side, wherein however also fewer or more cooling medium pipes can be provided, corresponding to the number of the cooling medium channels that are present.

It is known to fasten cooling plates of a furnace cooling system in very different ways to the inner surface of the furnace steel jacket. As a result of the changing thermal expansion of the cooling plates at different heat load, caused by the operation of the furnace, the type of fastening of the cooling plates is of utmost importance.

For example, it is known from DE-C-710 923 that cooling plates, which are secured by means of their water inlet and water outlet pipes inserted through the furnace steel jacket, are additionally suspended by securing and supporting cams on the furnace steel jacket.

Similarly, in U.S. Pat. No. 5,904,893 it is suggested to provide the cooling plates with a recess engaged by a supporting pin of the blast furnace steel jacket and to suspend them in this way from the furnace steel jacket.

In EP-A-0 837 144 the cooling plate is also suspended from the furnace steel jacket wherein the cooling plates have hooks which engage hooks welded to the furnace steel jacket. The hooks of the cooling plate can be formed as a rail for a better positioning of the cooling plate.

A fastening of a different type is suggested in DE-A-198 06 788. Here, the cooling plate is provided with a thread that extends through the furnace steel jacket so that the cooling plate can be attached to the furnace steel jacket by a screw connection.

Moreover, it is known from DE 27 43 380 A1 to fasten cooling plates made of cast iron on the furnace steel jacket of a blast furnace by means of screws which are provided toward the exterior with a sealing cover. A disadvantage of this type of fastening is that, at high heat loads of the cooling plates, these fastening screws expand and the cooling plates can move in the direction toward the center of the furnace so that hot furnace gas flows through the gap between the cooling plates and the furnace steel jacket and heats the furnace steel jacket in an uncontrolled way.

In DE 31 00 321 C1 it is therefore suggested to cast protective pipes into the cooling plates which surround at a spacing the cooling medium pipes in the area of the furnace steel jacket penetrations, wherein the openings within the furnace, steel jacket are sealed against leakage of furnace gases and wherein at least one of these protective pipes serves as a stationary bearing by being welded to the furnace steel jacket and wherein further protective pipes arranged in the same plane act as horizontally movable bearings. Moreover, at least one protective pipe, positioned opposite to the protective pipes serving as a stationary bearing, is configured as a vertically slidable bearing and the additional protective pipes arranged in this plane are provided as movable bearings. Each cooling medium pipe is connected by a disk with a metal compensator which is surrounded by a protective housing and is gas-tightly welded directly or by means of a pipe socket to the furnace steel jacket in order to seal the fastening locations of the cooling plate by means of protective pipes relative to undesirable furnace gas leakage.

From 296 08 464 U1 it is known to attach the cooling plate exclusively by means of its cooling medium pipes to the furnace steel jacket. In this connection, the cooling medium pipes are guided through bores in the furnace steel jacket and are elastically connected with the furnace steel jacket, on the one hand, by means of a compensator welded to the pipe socket and, on the other hand, by means of a wielding connection between the compensator and the cooling medium pipe.

It is an object of the invention to provide an attachment for copper cooling plates on a furnace steel jacket with which, without greater expenditure, the copper cooling plate can be mounted and removed and which makes it possible that at least some of the otherwise conventional compensators can be eliminated and which is also resistant to changing thermal loads.

This object is solved for a copper cooling plate of the aforementioned kind in that the copper cooling plates, in addition to the attachment by means of the cooling medium pipes welded to the furnace steel jacket, are connected to the furnace steel jacket by at least one fixed-point fastening element, for example, a fastening bolt, that is welded to the furnace steel jacket. According to the invention, two basic fastening variants are conceivable in this connection which can be employed depending on the size of the copper cooling plate and the number of cooling medium channels or cooling medium pipes.

For example, it is possible to suspend the copper cooling plate from a fastening bolt or another fastening element which is located in immediate proximity to the upper and/or lower cooling medium pipes guided through the furnace steel jacket. In this case, the fastening element is connected with the furnace steel jacket and the copper cooling plate such that the fastening element acts as a fixed point in all spatial directions. The immediate proximity of the fastening element to the cooling medium pipes, on the one hand, as well as the very low thermal expansion of the copper, on the other hand, lead to the thermal expansions, to be expected as a result of relative temperature fluctuations between the fastening element and the neighboring cooling medium pipes, being so minimal that the compensators on these cooling medium pipes can be eliminated. The cooling medium pipes can thus be welded directly, i.e., without compensators, to the furnace steel jacket and thus provide additional fixed points. The other cooling medium pipes are fastened, as is conventional, by means of compensators on the furnace steel jacket and provide thus movable points in all spatial directions. The copper cooling plate is moreover connected at further movable points by means of corresponding fastening elements, for example, screws with the furnace steel jacket with which movements caused by thermal expansion are possible in the vertical/horizontal direction.

A further variant for the attachment of the copper cooling plate resides in that the copper cooling plate is to be provided with at least one fixed point fastening element, for example, at the center of the copper cooling plate. The copper cooling plate, provided with additional movable point fastening elements, can then be welded entirely without compensators to the furnace steel jacket wherein all cooling medium pipes then act as additional fixed points. The thermal expansions to be expected between the fixed points, provided in this way, are so minimal that they can be neglected and no compensators are therefore required. The elimination of the compensators provides a significant advantage as a result of the reduced mounting and welding expenditure because a compensator would have to be welded in a gas-tight way, on the one hand, to the furnace steel jacket and, on the other hand, to the pipe socket of the copper cooling plate.

Those cooling medium pipes which do not require compensators according to the invention are gas-tightly welded from the exterior directly onto the furnace steel jacket and are arranged either by means of a perforated template or by means of a simple cylindrical cup which enlarges the spacing of the fixed point of the welded cooling medium pipe relative to the body of the copper cooling plate even more.

With the attachment of the copper cooling plate according to the invention it is thus possible to mount copper cooling plates on metallurgical furnaces, in particular, blast furnaces or other melting and melt-reduction furnaces, in a simpler, faster, and less expensive way.

Figure 2:
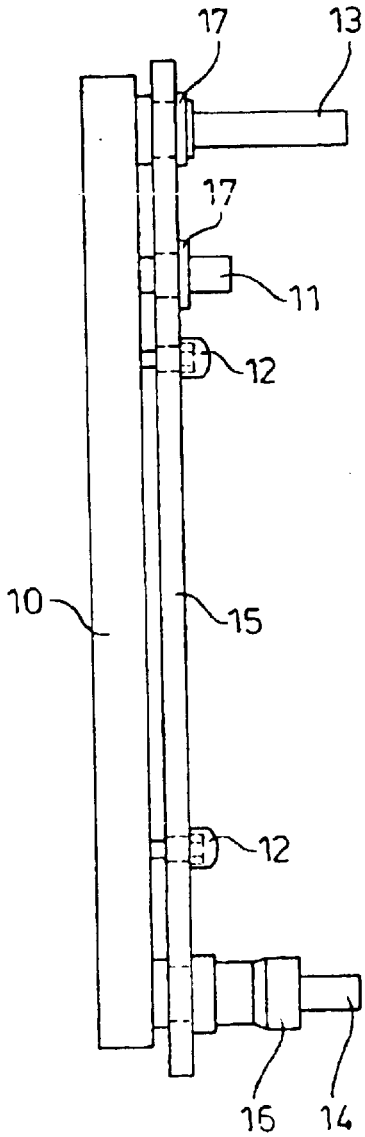
Figure 3:
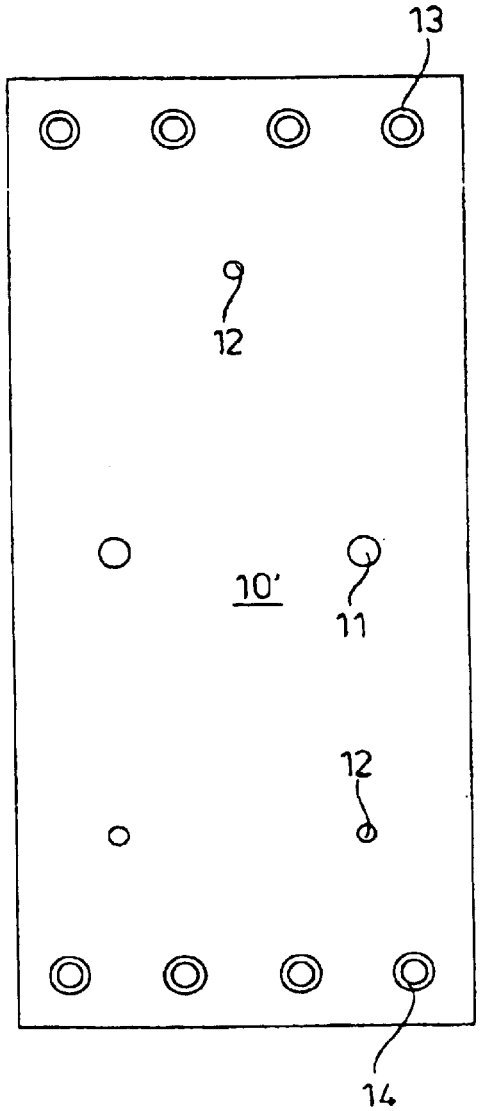
Figure 4:
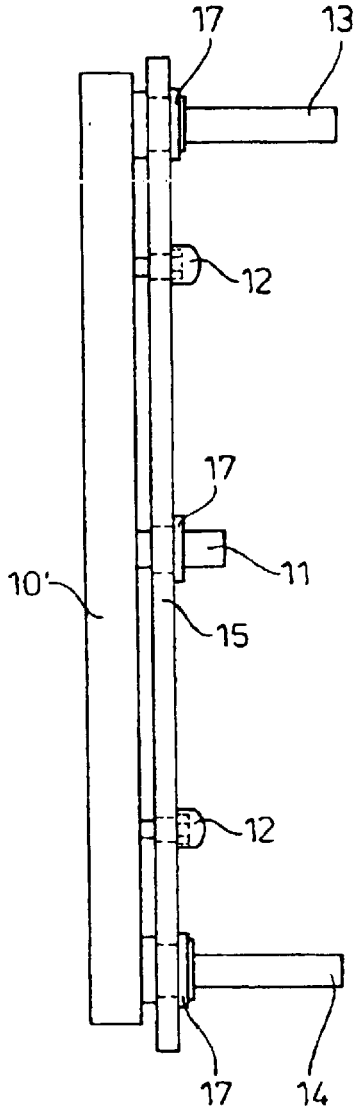

Further advantages, features, and details of the invention will be explained in more detail in the following with the aid of embodiments illustrated in the schematic drawing figures, wherein identical construction parts are identified with identical reference numerals. It is shown in:

FIG. 1 a plan view at the connecting side onto a copper cooling plate with one fixed-point fastening element arranged at the top, FIG. 2 a side view of the copper cooling plate with furnace steel jacket according to FIG. 1, FIG. 3 a plan view onto the connecting side of a copper cooling plate with two fixed-point fastening elements arranged at the center of the copper cooling plate, FIG. 4 a side view of the copper cooling plate with furnace steel jacket according to FIG. 3.

In FIGS. 1 and 2 a plan view (FIG. 1) and a side view (FIG. 2) of the copper cooling plate 10 with four cooling medium channels (not shown) are illustrated whose cooling medium pipes 13, 14 for supplying and removing the cooling medium are arranged at the upper part and the lower part of the copper cooling plate 10. In immediate proximity of the upper cooling medium pipe 13 a fastening bolt as a fixed-point fastening element 11 is arranged which is welded with a washer 17 onto the furnace steel jacket 15.

As a result of the spatial proximity of the fixed-point fastening element 11 to the cooling medium pipes 13, these cooling medium pipes 13 can be welded directly, without the otherwise conventional compensators, onto the furnace steel jacket 15 with a washer 17.

The lower cooling medium pipes 14, which are moved spatially too far from the fixed-point fastening element 11, are connected in an unchanged way with compensators 16 to the furnace steel jacket 15.

Moreover, several movable point fastening elements 12, in the form of fastening screws in this embodiment, are arranged across the surface of the copper cooling plates 10 in a symmetrical distribution for the purpose of an additional attachment of the copper cooling plates 10 on the furnace steel jacket 15.

By means of the attachment according to the invention of the copper cooling plate 10 on the furnace steel jacket 15, the forces resulting from thermal expansion are received without problem wherein the upper cooling medium pipes 13 and the fastening bolt 11 are fixed points, the lower cooling medium pipes 14 with compensators 16 are movable points movable in all spatial directions, and the fastening screws 12 act also as movable points in the vertical/horizontal direction.

In FIGS. 3 and 4 in a plan view (FIG. 3) and in a side view (FIG. 4) a further fastening type or embodiment according to the invention of a copper cooling plate 10' in connection with the furnace steel jacket 15 is illustrated. In this embodiment, two fixed-point fasting elements 11 (fastening bolts) are arranged at the center of the copper cooling plate 10'. In addition, as also disclosed in the embodiment of FIGS. 1 and 2, further moveable point fasting elements 12 (fasting screws) are present. In this fasting variant illustrated in FIGS. 3 and 4, all compensators can be eliminated because the relative thermal expansions between the fixed-point fasting elements and the fixed positions of the upper and also the lower cooling medium pipes 13 are so minimal that they can be neglected. The attachment of the copper cooling plate 10' in this case thus is comprised of the fixed points of the fastening bolts 11 and the welded cooling medium pipes 13, 14 as well as the movable points (in vertical/horizontal direction) of the fastening screws 12.

The invention is not limited to the illustrated embodiments; instead, in particular, with respect to the number and arrangement of the fixed-point and moveable point fasting elements as well as their configuration as bolts or screws, variants that depend on the size of the copper cooling plate are possible, as long as they enable the elimination of compensators in accordance with the invention.

What is claimed is:

1. A metallurgical furnace, such as a blast furnace, melting or melt-reduction furnace, provided with a refractory lining and an outer furnace steel jacket (15), comprising copper cooling plates (10, 10'), wherein a flow of cooling medium flows through the cooling plates arranged between the furnace steel jacket (15) and the refractory lining, wherein cooling medium pipes (13, 14) of the copper cooling plate (10, 10') provided for supplying and removing the cooling medium are guided through the furnace steel jacket (15) to the exterior and are gas-tightly welded to the furnace steel jacket (15), wherein the copper cooling plate (10, 10') is connected free of play in all spatial directions to the furnace steel jacket (15), in addition to attachment by means of the cooling medium pipes (13, 14) welded to the furnace steel jacket (15), by at least one fixed-point fastening element (11) that is welded to the furnace steel jacket (15), the at least one fixed-point fastening element being arranged within at least one of the upper part and the lower part of the copper cooling plate immediate proximity of the cooling medium pipes.

2. A metallurgical furnace, such as a blast furnace, melting or melt-reduction furnace, provided with a refractory lining and an outer furnace steel jacket (15), comprising copper cooling plates (10, 10'), wherein a flow of cooling medium flows through the cooling plates arranged between the furnace steel jacket (15) and the refractory lining, wherein cooling medium pipes (13, 14) of the copper cooling plate (10, 10') provided for supplying and removing the cooling medium are guided through the furnace steel jacket (15) to the exterior and are gas-tightly welded to the furnace steel jacket (15), wherein the copper cooling plate (10, 10') is connected free of play in all spatial directions to the furnace steel jacket (15), in addition to attachment by means of the cooling medium pipes (13, 14) welded to the furnace steel jacket (15), by at least one fixed-point fastening element (11) that is welded to the furnace steel jacket (15), at least one of the fixed-point fastening elements (11) being arranged at the center of the copper cooling plate (10, 10').

3. The metallurgical furnace according to claim 1, wherein the copper cooling plate (10, 10') is additionally fastened fixedly to the furnace steel jacket (15) by at least one movable point fastening element (12), for example, a fastening screw, which allows thermal expansion movements of the copper cooling plate (10, 10') in the horizontal and vertical direction.

4. The metallurgical furnace according to claim 2, wherein the copper cooling plate (10, 10') is additionally fastened fixedly to the furnace steel jacket (15) by at least one movable point fastening element (12), for example, a fastening screw, which allows thermal expansion movements of the copper cooling plate (10, 10') in the horizontal and vertical direction.

5. The metallurgical furnace according to claim 1, wherein at least some of the cooling medium pipes (13, 14) are welded without use of a compensator directly to the furnace steel jacket (15).

6. The metallurgical furnace according to claim 2, wherein at least some of the cooling medium pipes (13, 14) are welded without use of a compensator directly to the furnace steel jacket (15).

* * * * *